United States Patent [19]

Yamasaki

[11] 4,135,328

[45] Jan. 23, 1979

[54] CLUTCH MECHANISM FOR A TOY VEHICLE

[75] Inventor: Toshio Yamasaki, Long Beach, Calif.

[73] Assignee: Mattel, Inc., Hawthorne, Calif.

[21] Appl. No.: 761,496

[22] Filed: Jan. 21, 1977

[51] Int. Cl.[2] ..... A63H 29/20

[52] U.S. Cl. ..... 46/202; 46/209

[58] Field of Search ..... 46/201, 202, 206, 209

[56] References Cited

U.S. PATENT DOCUMENTS

| | | | |
|---|---|---|---|
| 2,829,467 | 4/1958 | Pagano | 46/209 |
| 3,611,631 | 10/1971 | Folson | 46/206 |
| 3,757,459 | 9/1973 | Buck et al. | 46/206 |
| 3,798,831 | 3/1974 | Higashi | 46/206 |
| 3,886,682 | 6/1975 | Ieda | 46/202 |
| 3,932,956 | 1/1976 | Young | 46/202 |

*Primary Examiner*—Louis G. Mancene
*Assistant Examiner*—Robert F. Cutting
*Attorney, Agent, or Firm*—John G. Mesaros; Max E. Shirk; Ronald M. Goldman

[57] ABSTRACT

A unidirectional clutch mechanism for use in a toy vehicle or the like having an inertia motor energized by a spring-return drawstring mechanism having a drive spool receiving the drawstring and the return spring, the drive spool having a drive disc portion with an integral square shank loosely encircled by a clutch disc with a circumferentially disposed slot engaged by an arcuate projection on the surface of the drive disc, the projection being shorter in length to allow relative motion between the discs. The opposite surface of the clutch disc is provided with a pair of diametrically opposed bearing members, each pivotally receiving a pawl of a unitary spring member having a square portion engaging the square shank with spring portions extending therefrom to pivot said pawls upon relative motion between the shank and the clutch disc. A drive gear is rotatably mounted coaxial with the drive disc and clutch disc, the drive gear having a drive disc portion with a cylindrical recess having inwardly extending drive lugs configured to be engaged by the pawls only when the drive disc portion is displaced relative to the clutch disc thereby pivoting the pawls. The drive wheel is coupled to an inertia flywheel and to an intermediate clutch wheel and other clutch means which can be coupled through intermediate gears to either a first or second drive wheel.

6 Claims, 6 Drawing Figures

CLUTCH MECHANISM FOR A TOY VEHICLE

BACKGROUND OF THE INVENTION

The background of the invention will be discussed in two parts:

1. Field of the Invention

This invention relates to clutch mechanisms and more particularly to a unidirectional clutch mechanism in which the driven member is free-wheeling in both directions of rotation.

2. Description of the Prior Art

Unidirectional clutch mechanisms utilizing pawls, dogs, detents or the like are commonly used, some of which are shown in U.S. Pat. Nos. 1,584,246; 1,883,966; 2,051,116; and 2,620,052. Such clutches find applications in various devices such as handoperated sweepers, power press driving mechanisms, fishing reels and the like, but generally although the clutch mechanism is unidirectional, when the clutch components engage the driven member, the driven member is freely rotatable only in one direction. In the clutch mechanism illustrated in U.S. Pat. No. 1,883,966 for "Overrunning Clutch" the coupling is effected by means of detents coacting with ratchet notches. A separate member is provided coaxial with the notched portion and rotatable with respect thereto through a limited angle, the separate member being side plates that have notches corresponding to the notches in the wheel. With the clutch operated in an overrunning direction the side plates are permitted to move, with the member carrying the detents, through an angle to a position in which the notches in the plates are no longer in line with the notches in the ratchet wheel thereby providing a circular surface to the detents.

Clutches of the overrunning type, such as that described as well as the clutch mechanisms in the aforementioned patents are not suitable generally for small objects where compactness, efficiency of operation, reliability and ability to be mass produced are basic requirements.

It is accordingly an object of this invention to provide a new and improved clutch mechanism.

It is another object of this invention to provide a new and improved clutch mechanism for an inertia motor-operated toy vehicle.

It is a further object of this invention to provide a new and improved clutch mechanism that will drive unidirectionally but allow the driven member to be free-wheeling in both directions of rotation.

SUMMARY OF THE INVENTION

The foregoing and other objects of the invention are accomplished by providing a drive spool rotatably mounted on an axle, the spool having a drawstring receiving portion and a return spring receiving portion. One surface of the spool is configured as a drive disc with an integral square shank loosely engaged by a clutch disc with a circumferentially disposed slot engaged by an arcuate projection on the surface of the drive disc, the fit of the projection within the slot permitting a certain amount of lost motion or relative rotation between the clutch disc and the drive disc. The opposite surface of the clutch disc is provided with a pair of diametrically opposed bearing members, each pivotally receiving a pawl of a unitary spring member having a main body portion with a square aperture engaging the square shank and oppositely disposed spring members secured to the pawls to thereby pivot the pawls upon relative motion of the clutch disc with respect to the drive discs. Upon pivoting, the pawls are adapted to engage inwardly extending drive lugs within a cylindrical recess of a drive disc of a drive gear, the drive gear being freely rotatable in either direction with the pawls in the normal unpivoted position. The drive gear is coupled to an inertia wheel and to an intermediate clutch wheel freely rotatable upon a shaft, the intermediate clutch wheel being selectively coupled to a first or second drive wheels on a toy vehicle or the like through gear means to provide a different speed ratio to each drive wheel. The selection of drive wheels is accomplished through a shifting mechanism.

Further objects, features and advantages of the invention will become apparent upon a reading of the specification when taken in conjunction with the drawings in which like reference numerals refer to like elements in the several views.

DESCRIPTION OF THE PREFERRED EMBODIMENT

Figure 1:
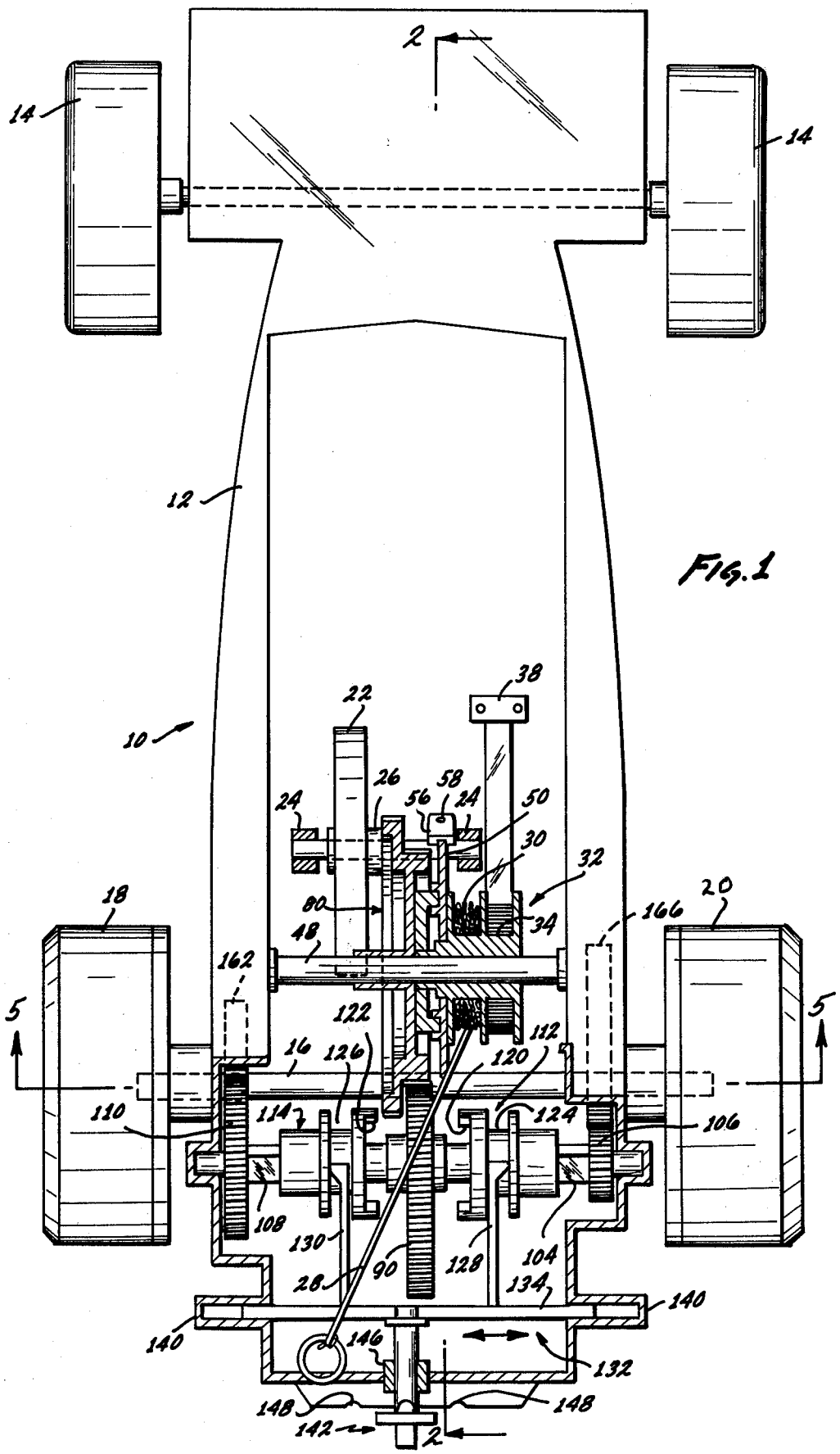
FIG. 1 is a plan view, partially in cross section, of a toy vehicle frame utilizing the clutch mechanism according to the invention.

Referring now to the drawings and particularly to FIG. 1 there is shown a vehicle generally designated 10 having, in conventional toy vehicle fashion, a frame 12 having rotatably supported at the front end thereof a pair of free-running wheels 14 and a parallel rear axle 16 having rotatably secured to either end thereof a first drive wheel 18 and a second drive wheel 20. The vehicle is powered by an inertia motor including a flywheel 22 rotatably mounted within bearings 24 secured within frame 12. The flywheel 22 has a pinion 26 formed integrally therewith along the shaft thereof.

Briefly the flywheel 22 is intended to be actuated by the clutch mechanism according to the invention by pulling on a drawstring 28 extending out through the rear of the vehicle 10, the drawstring 28 having one end thereof secured to a first drum portion 30 of a drive spool generally designated 32, the drive spool 32 having a second drum portion 34 having secured thereto one end of a coil spring or return spring 36, the other end of which is secured at 38 to frame 12 of the vehicle 10. The drawstring 28 is wound about the drum portion 30 in a first direction while the return spring 36 is coiled about the second drum portion in an opposite direction with the net effect being that the drawstring 28 pulls against the bias of return spring 36, which upon release of drawstring 28 recoils it about the drum portion 30. This pulling of drawstring 28 repeatedly against the force of return spring 36 will operate through the clutch mechanism to be hereinafter described to rotate the flywheel 22 to energize the inertia motor and ultimately drive the vehicle. Although a single pull of drawstring 28 will energize the flywheel 22, upon repeated pulling of drawstring 28 prior to placing the vehicle 10 on a surface a larger number of revolutions per minute can be effected for the flywheel 22. The vehicle is provided with other clutch means which are adapted to selectively engage either the first drive wheel 18 or the second drive wheel 20, each of which can be direct coupled to the flywheel 22 through different gear ratios to provide a two-speed vehicle with the other clutch means also having a neutral position in which neither drive wheel is coupled to the flywheel. In any event, the clutch mechanism connecting the drive spool 32 to the flywheel 22, intermittently, is such that the clutch mechanism operates only when the drawstring 28 is pulled. With all components at rest, on the other hand, and the drive wheel clutch means selected, the driven member of the flywheel clutch mechanism, although at this point directly coupled to one of the drive wheels, is free to rotate in either direction. For discussion purposes, since the vehicle 10 contains two different clutch assemblies, the clutch mechanism according to the invention will be hereinafter referred to as the flywheel clutch mechanism, and the clutch assembly for selecting one of the two drive wheels 18 and 20 will be referred to as the drive wheel clutch mechanism.

Figure 4:
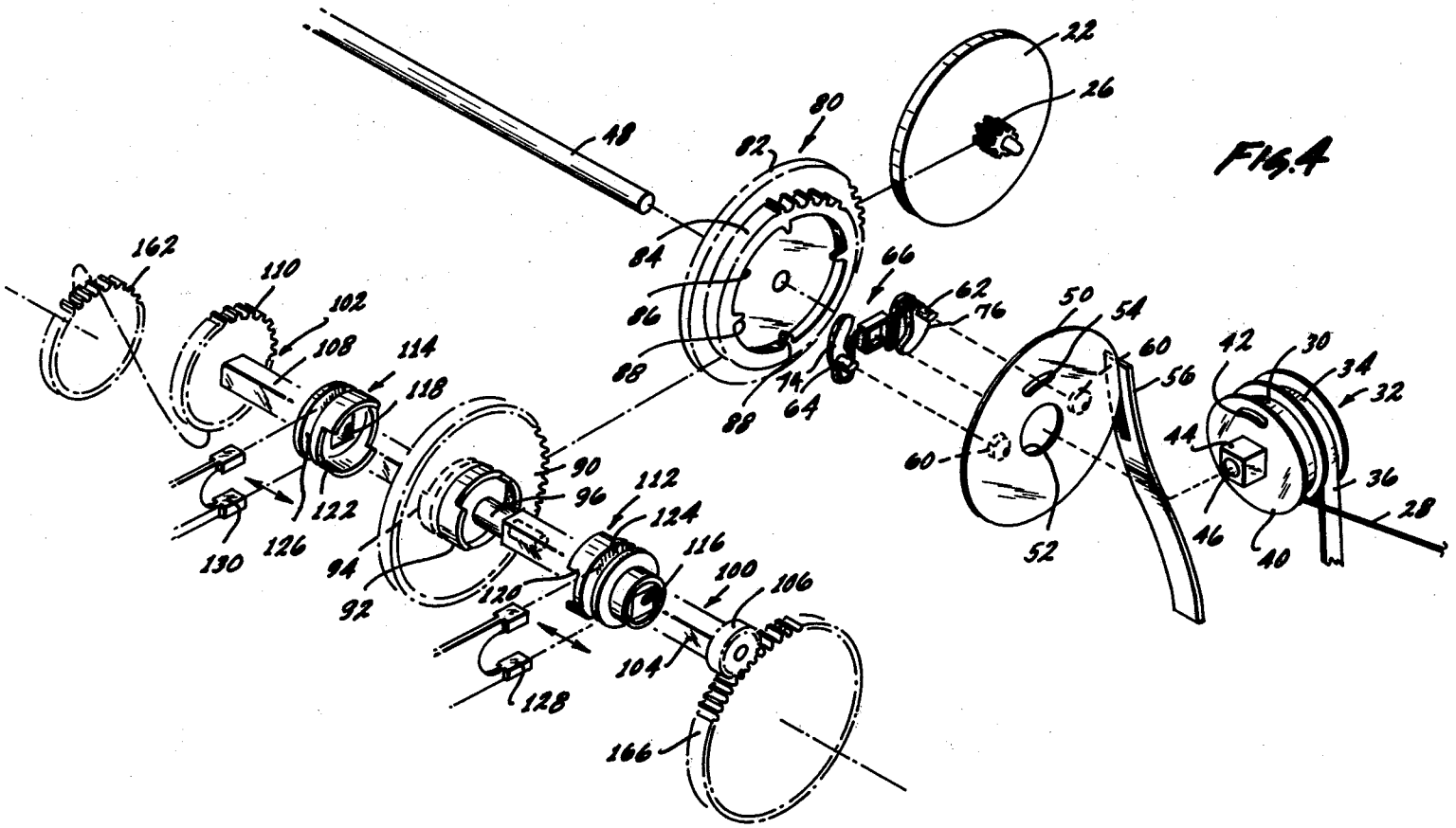
FIG. 4 is an exploded perspective view showing the components of the clutch mechanism and drive mechanism of the vehicle of FIG. 1.

Referring again to FIG. 1 and also particularly to FIG. 4 the details pertaining to the flywheel clutch mechanism will be described. As shown in FIG. 4 the drive spool 32 has a drive disc surface 40 having an arcuate projection 42 extending transverse to the surface thereof adjacent the periphery thereof. The drive spool 32 is provided with a square shank portion 44 having an aperture 46 extending therethrough and through drive spool 32. A shaft or axle 48 extends through aperture 46 for rotatably receiving drive spool 32, the axle 48 being suitably mounted within frame 12 in a direction generally parallel to axle 16 of drive wheels 18 and 20. A clutch plate or disc 50 has an enlarged circular aperture 52 at the center thereof, the aperture 52 having a diameter slightly greater than the diagonal of square shank 44, the clutch disc 50 being mounted over shank 44. A circumferentially disposed slot 54 loosely engages the arcuate projection 42 on drive disc 40 with the circumferential length of slot 54 allowing approximately 15° of lost motion or relative movement between clutch disc 50 and drive disc 40 with the parts in abutting relation on shank 44. The clutch disc 50 has a greater diameter than drive disc 40 and the outer periphery of clutch disc 50 is engaged by a slotted brake spring 56 urging thereagainst with the lower end of brake spring 56 suitably secured within frame 12 as at 58 (see FIG. 1).

Figure 2:
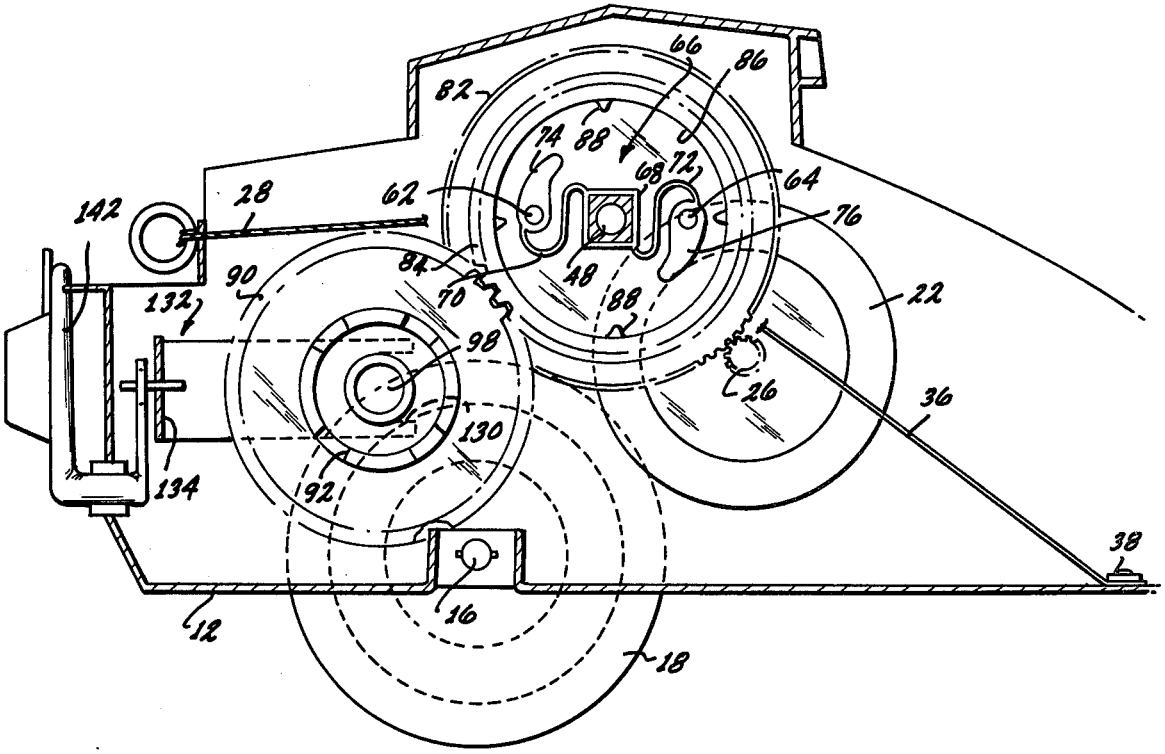
FIG. 2 is a side cross-sectional view of the toy vehicle of FIG. 1 taken generally along line 2—2 thereof and partially cut away.

The surface of clutch disc 58 opposite the surface engaging or abutting against drive disc 40 is provided with a pair of diametrically opposed axially extending bearing receiving projections 60 having bearing apertures therein for receiving bearing pins 62 and 64 of a unitary pawl member generally designated 66. Referring also to FIG. 2 the pawl member 66 has a main body portion 68 with a square aperture therethrough for matingly engaging the square shank 44 of drive spool 32. Integral with diagonally opposed corners of main body portion 68 are opposing spring sections 70 and 72 respectively terminating at bearing pins 62 and 64 respectively. Extending in a direction opposite from springs 70 and 72 at bearing pins 62 and 64 are pawls 74 and 76 respectively, the outer arcuate edges of which generally define a circle of a given diameter. As can be seen in FIG. 2 the spring sections 70 and 72 are connected to pawls 74 and 76 respectively at a point offset from the centers of bearing pins 62 and 64 respectively. As will hereinafter be discussed the net effect of this offset from the center of the bearing pins creates a turning moment during the relative displacement of drive disc 40 with respect to clutch disc 50, this turning moment being about bearing pins 62 and 64 to pivot the free ends of pawls 74 and 76 outwardly to a greater radial distance from the center of shaft or axle 48.

Figure 3:
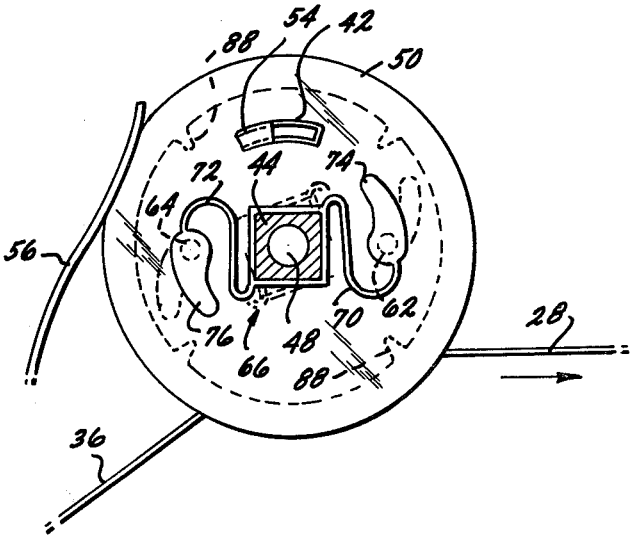
FIG. 3 is a side view of the clutch mechanism, partially diagramatic, illustrating the operation of the mechanism.

The pawl member 66 is essentially surrounded by a portion of a driven member or drive gear generally designated 80. The drive gear 80 has a first larger diameter gear portion 82 adapted to mesh with the pinion 26 of flywheel 22, and a smaller diameter gear portion 84. The drive gear 80 is essentially in the form of a third disc having a circular recess portion 86 configured in one surface thereof with two pairs of inwardly extending radial lugs 88 displaced at 90° intervals, the inner extent of lugs 88 defining a circle having a diameter greater than the non-pivoted diameter of the circle defined by the outer arcuate periphery of pawls 74 and 76. The relative diameters are such that with pawls 74 and 76 pivoted the free ends thereof are adapted to engage lugs 88 in only one direction, that direction being in the clockwise direction of rotation of shank 44 as viewed in FIG. 2 and in the counterclockwise direction as viewed in FIG. 3. FIG. 2 is a view of the drive gear 80 and its relation to pawl member 66 as viewed from right to left in FIG. 1 while FIG. 3 is a view taken in the opposite direction illustrating the clutch disc 50 with pawl member 66 mounted on shank 44 with arcuate projection 42 engaged within slot 54 of clutch disc 50. In dotted lines about the periphery thereof the position of the lugs 88 are illustrated with reference to the pawls 74 and 76.

Referring now especially to FIG. 3 the operation of the flywheel clutch mechanism will be discussed. As the drawstring 28 is pulled in the direction of the arrow adjacent thereto the arcuate projection 42 carried by the drive spool 32 will commence rotation in a counterclockwise direction, the projection 42 being illustrated in solid lines adjacent the right-hand edge of slot 54, this being the normal un-actuated condition of the flywheel clutch mechanism. With the projection 42 in the solid line position shown the pawl member 66 will be in the solid line position shown with the pawls 74 and 76 out of engagement with lugs 88. As drawstring 28 is pulled the drive spool 32 is rotated along with the arcuate projection 42 and the square shank 44 in the counterclockwise direction until the projection 42 engages the left edge (shown in dotted lines) of slot 54 at which point due to the friction of brake spring 56 against the periphery of clutch disc 50 rotation of clutch disc 50 is resisted. With the square shank 44 rotating through the angle permitted by slot 54 relative to clutch disc 50 the pawl member 66 carried thereby is rotated or pivoted to its dotted line position thereby displacing the attached edges of the integral leaf spring members 70 and 72 respectively to apply a turning force to pawls 74 and 76 respectively which are then pivoted to the dotted line positions shown. As the drive spool 32 continues to rotate the engagement of arcuate projection 42 with the edge of slot 54 rotates clutch disc 50 while maintaining the engagement to thereby maintain the pawls 74 and 76 in the pivoted condition engaging lugs 88 thereby driving drive gear 80 which ultimately rotates flywheel 22 due to the meshing of the gears 82 of drive gear 80 with the pinion 26 of flywheel 22. When drawstring 28 is released the drive spool 32 is then rotated in a clockwise direction under the force of return coil spring 36 and during this clockwise rotation of drive spool 32 along with clutch disc 50 a relative displacement between clutch disc 50 and the adjacent drive disc 40 occurs when arcuate projection 42 moves clockwise with respect to the slot 54 to the solid line position shown in FIG. 3 thereby pivoting pawl member 66 to reposition the pawls 74 and 76 thereof back to the solid line position wherein the flywheel clutch mechanism is then ready for a subsequent actuation. As will hereinafter be discussed the drive gear 80 is adapted to be coupled with the drive train of the vehicle and since the movement or rotation of drive gear 80 is independent of the flywheel clutch mechanism when the latter is not being actuated, the drive gear 80 is free to rotate in either direction thus resulting in a clutch mechanism which will drive unidirectionally although permitting drive gear 80 to be operated in both directions in the absence of the actuation.

Figure 5:
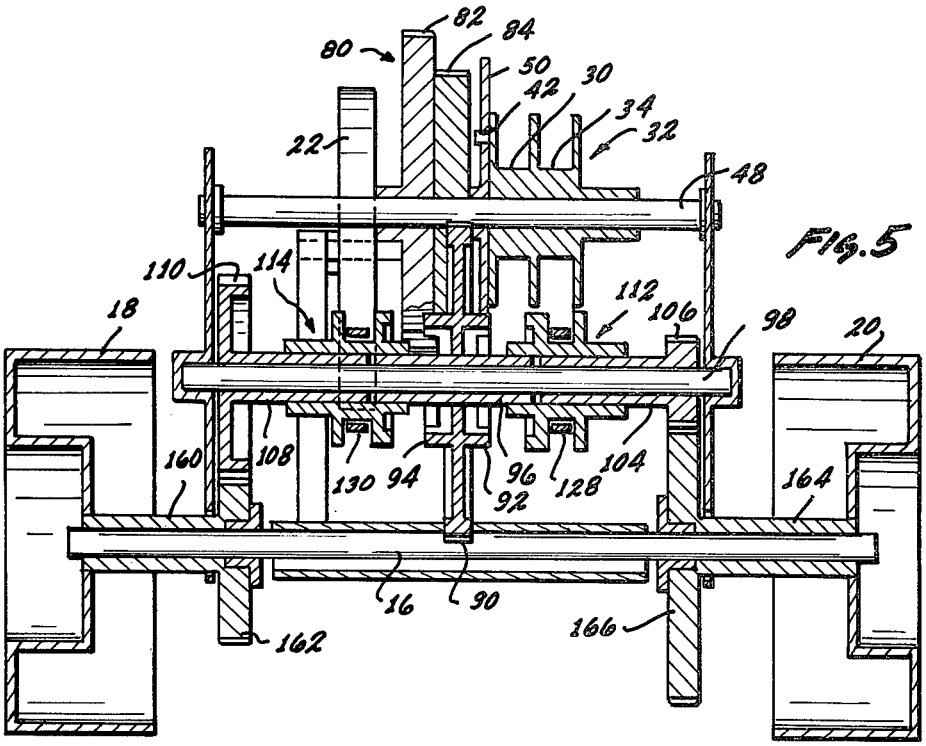
FIG. 5 is a cross-sectional view taken along line 5—5 of FIG. 1.
Figure 6:
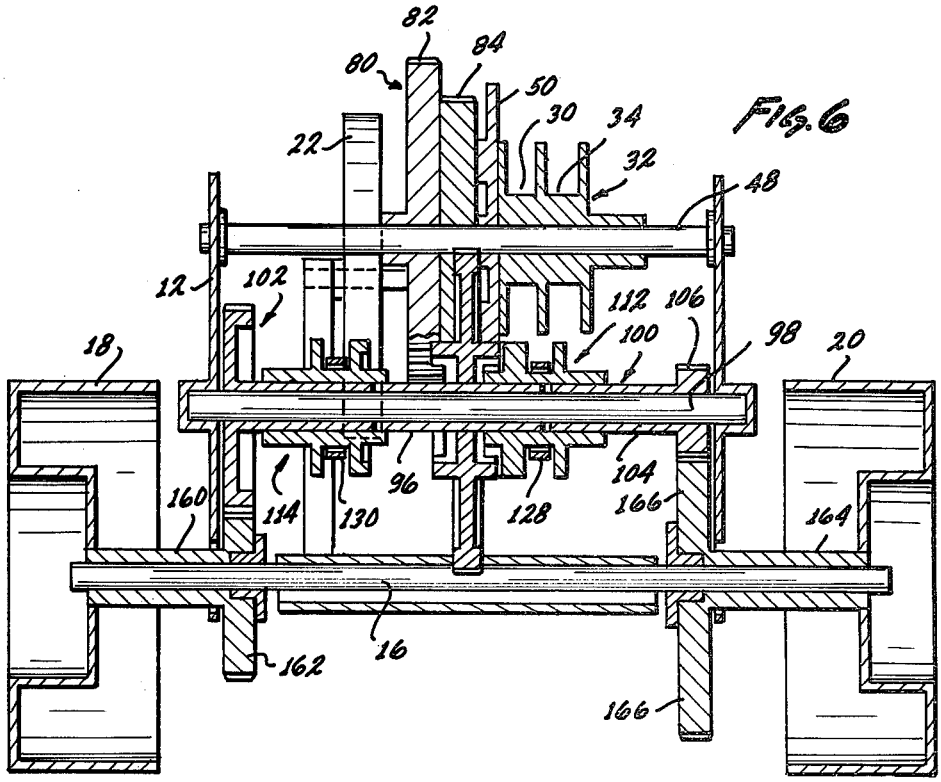
FIG. 6 is a cross-sectional view similar to FIG. 5 showing the intermediate clutch wheel engaged to drive one drive wheel.

The details pertaining to the drive train and drive wheel clutch mechanism will now be discussed with reference to FIGS. 1, 2, and 4–6. As shown in FIG. 4 the drive train includes a large diameter intermediate spur gear 90 the gear teeth of which mesh with the gear 84 of drive gear 80. The spur gear 90, on either surface thereof has segmented cylindrical portions 92 and 94 respectively and a centrally disposed circular shaft 96 integral therewith, the shaft 96 having an aperture therethrough for rotatably mounting spur gear 90 on an axle 98 (see FIGS. 1, 5 and 6), the axle 98 being suitably secured within frame 12 in a direction parallel to axle 16. As can be seen the spur gear 90 is generally centrally disposed with respect to the opposing sidewalls of frame 12 on axle 98. Positioned on either side of the circular shaft 96 of spur gear 90 rotatably with respect to axle 98 are a first gear member generally designated 100, and a second gear member generally designated 102. Gear member 100 has a splined or square body portion 104 terminating in a small diameter spur gear 106, the body portion 104 having an aperture extending therethrough for rotatably mounting the first gear member 100 on axle 98. Similarly the second gear member 102 has a main splined or square body portion 108 terminating in a larger diameter spur gear 110. As can be seen in FIGS. 5 and 6 the axle 98 has the surface thereof virtually encompassed from left to right between opposing sidewalls of frame 12 by the second gear member 102, the spur gear member 90 and the first gear member 100 with the cross sections adjacent axle 98 being a square cross section for gear member 102, a round cross section for spur gear shaft 96, and a square cross section for the body portion 104 of the first gear member 100. Axially slidably positioned on the body portion 104 of the first gear member 100 is a first clutch member generally designated 112 while a second similar clutch member 114 is axially slidably positioned on body portion 108 of the second gear member 102, each of the clutch members 112 and 114 having a square aperture 116 and 118 respectively extending therethrough for matingly engaging the square body portion. The portions of the respective clutch members spacing the segmented cylinder portions 92 and 94 of spur gear member 90 are configured as dogs or segmented cylinders for matingly coacting with the segmented cylindrical portions 92 and 94 respectively, the clutch portions being designated 120 and 122 respectively. Intermediate the opposite ends of clutch member 112 is a reduced diameter journal portion 124 with a corresponding journal 126 being formed in the second clutch member 114. Coacting within the journals are two pairs of forks designated 128 and 130 respectively, the forks 128 and 130 being integrally formed in a slidable shifting member generally designated 132 (see FIG. 1). The shifting member 132 has a main bar portion 134 from which the fork portions 128 and 130 extend transversely to engage the respective journals, the bar 134 being movable in either direction as indicated by the double-ended arrow adjacent thereto to slide within mating projections 140 formed integrally in the sidewalls of framework 12. The sliding action is effected by any suitable means such as a shift lever 142 pivotally mounted by means of a bearing 146 within frame 12. The shift lever 142 as viewed in FIG. 1 is in the "neutral" position and can be detented to either side thereof by means of detents 148 to selectively couple either gear member 100 or gear member 102 for concurrent rotation with spur gear member 90.

Functionally the drive wheel clutch mechanism operates in the following manner. The clutch members 124 and 126 are slidable axially on the coacting splined or square body portions 104 and 108 respectively and are rotatable with gears 106 and 110 respectively. However, with the shifting member 132 in the position shown in FIG. 1 and FIG. 5 neither clutch member 124 or 126 is engaging the spur gear member 90 which rotates independently of either clutch member 124 or 126 unless engaged therewith. By the pivoting of shift lever 142 to either of the detents 148 on either side thereof the main bar portion 134 of the shifting member 132 is moved laterally, and if moved to the left, the configuration shown in FIG. 6 will occur, that is with the dogs or segmented cylinder portion 120 of clutch member 112 in engagement with the segmented cylindrical portion 92 of spur gear member 90 thereby solidly coupling spur gear member 90 to the first gear member 100 for concurrent rotation of gear 106 and spur gear 90. Consequently, with flywheel 22 rotating power will be transmitted from pinion 26 of flywheel 22 through drive gear 80 by means of the gear teeth 82 thereof engaging the pinion 26, this power then being transferred by means of the gear teeth 84 of drive gear 80 engaging the spur gear 90 and with the segmented cylindrical portions 92 in engagement with the mating portion 120 of clutch member 112 to the gear 106 which rotates at a speed proportional to the relative gear ratios.

As shown in FIGS. 5 and 6 particularly, the first drive wheel 18 is provided with an integral hub portion 160 which is rotatably received on axle 16, the hub 160 having secured to the end thereof opposite drive wheel 18 a gear 162. The gear 162 is secured for concurrent rotation with drive wheel 18 and positioned for meshing engagement with the gear 110 of the second gear member 102. Similarly the second drive wheel 20 is provided with a hub portion 164 having secured to the end thereof a gear 166 of larger diameter than gear 162 for meshingly engaging the smaller diameter gear 106 of the first gear member 100.

In the position shown in FIG. 6 "low" gear has been selected to provide power to the toy vehicle 10 with drive wheel 20 providing the transmission force when in contact with a surface with flywheel 22 rotating. In this position the drive wheel 18 does not receive power from the flywheel 22 since the clutch member 114 associated therewith is out of engagement with the spur gear member 90. It is to be emphasized that both clutch members 112 and 114 move in the same direction at the same time due to the single shifting member 132 having the forks 128 and 130 simultaneously coacting with both clutch members. Consequently in this "low" gear position any movement of drive wheel 18 will be in response to the rotation thereof on the surface during movement of the toy vehicle 10. If the shifting member 132 is moved to the right clutch member 112 will be moved axially to the right on body portion 104 of the first gear member 100 with clutch member 114 being moved axially to the right until the segmented cylinder portion 122 thereof engages the segmented cylinder portion 94 of the spur gear member 90. In this condition the toy vehicle 10 will be in "high" gear, that is providing speed as opposed to power, with the power transmission from flywheel 22 being transferred to the spur gear member 90 through clutch member 114 coacting therewith to the second gear member 102 wherein the gear 110 thereof transfers the power through gear 162 to the first drive wheel 18.

With one of the clutch members 112 or 114 engaging the spur gear member 90, the toy vehicle 10 is capable of having its inertia motor energized by rotation of the flywheel 22 in conventional fashion by repeatedly moving the vehicle on a surface in a given direction, since with one of the clutch members engaged a direct gear coupling is effected between one of the drive wheels 18 or 20 and the flywheel 22. Furthermore the flywheel 22 can be rotated in either direction in this manner. With the shifting member 132 in the "neutral" position, with neither clutch member engaging the spur gear member 90 the vehicle 10 can be played with as a conventional free-wheeling four-wheel toy vehicle and can be rolled in either direction. In the neutral position with the toy vehicle 10 being moved manually, in addition to the wheels, the only members which would be rotating would be the first and second gear members 100 and 102 respectively along with the respective clutch members 112 and 114.

Consequently what has been described hereinabove is a fly-wheel actuating mechanism which can be utilized to impart motion to a driven member such as drive gear 80 which is then used to impart motion to a flywheel 22 to an inertia motor with drive gear 80 being able to be selectively coupled to a first or second drive wheels 18 or 20 through gear members which provide different ratios of speed between the selected drive wheel and the rotating flywheel 22. Furthermore the vehicle 10 is capable of different modes of operation wherein the flywheel 22 can be energized in conventional fashion; the flywheel 22 can be energized by pulling on the drawstring 28 to activate the flywheel clutch mechanism to thereby drive it; or the vehicle can be utilized as a free-wheeling vehicle with the shifting member 132 in the "neutral" position. While there has been shown and described a preferred embodiment it is to be understood that various other adaptations and modifications may be made within the spirit and scope of the invention.

What is claimed is:

1. In a toy vehicle having at least one drive wheel, the combination comprising:

a flywheel rotatably mounted within said vehicle;

an axle supported within said vehicle;

a drive gear rotatably mounted on said axle and coupled to said flywheel, said drive gear having lug means on a side surface thereof;

a drive member rotatably mounted on said axle adjacent said surface, said drive member being spring-biased in a first direction of rotation and having drawstring means coupled thereto for rotating said drive member in an opposite direction of rotation;

clutch means coupled to said drive member, the coupling being such as to permit rotation of said clutch means relative to said drive member through a limited angle and concurrent rotation with said drive member beyond said limited angle;

other means operatively coupled to said drive member and said clutch means and being responsive to relative motion in a first direction between said clutch means and said drive member for engaging said lug means to rotate said drive gear in said first direction of rotation, said other means being responsive to relative motion between said clutch means and said drive member in the opposite direction for disengaging said other means from said drive gear; and gear means coupling said drive gear to said drive wheel.

2. The combination according to claim 1 wherein said drive member includes a drive disc and said clutch means includes a clutch disc in abutting relation therewith.

3. The combination according to claim 2 wherein said clutch disc is operatively coupled to said drive disc by means of a slot in said clutch disc coacting with a projection on said drive disc extending therein, the length of said slot defining the limited angle.

4. The combination according to claim 3 wherein said drive gear has a circular recess and said lug means are inwardly extending radial lugs.

5. The combination according to claim 4 wherein said other means is a pawl member mounted for concurrent rotation with said drive disc, said pawl member having opposing pawls pivotally mounted on said clutch disc, the free ends of said pawls being pivotable outwardly in response to relative motion in said first direction and being retracted in response to the relative motion in the opposite direction.

6. The combination according to claim 5 wherein said toy vehicle has a first and second drive wheels independently rotatably coupled to the same axle and said gear means includes other clutch means for selectively coupling one of said first and second drive wheels to said drive gear.

* * * * *